US009532620B2

(12) United States Patent
McGuire et al.

(10) Patent No.: US 9,532,620 B2
(45) Date of Patent: Jan. 3, 2017

(54) TOWEL CAPE AND METHOD

(71) Applicants: Pededia Jalonne McGuire, Chicago, IL (US); Willie D. McGuire, Lima, OH (US)

(72) Inventors: Pededia Jalonne McGuire, Chicago, IL (US); Willie D. McGuire, Lima, OH (US)

( * ) Notice: Subject to any disclaimer, the term of this patent is extended or adjusted under 35 U.S.C. 154(b) by 209 days.

(21) Appl. No.: 14/567,528

(22) Filed: Dec. 11, 2014

(65) Prior Publication Data

US 2015/0320180 A1 Nov. 12, 2015

Related U.S. Application Data

(60) Provisional application No. 61/990,470, filed on May 8, 2014.

(51) Int. Cl.

| | |
|---|---|
| ***A41D 3/08*** | (2006.01) |
| ***A42B 1/04*** | (2006.01) |
| ***A45D 44/08*** | (2006.01) |
| *A47K 10/02* | (2006.01) |

(52) U.S. Cl.

CPC ..... *A42B 1/041* (2013.01); *A41D 3/08* (2013.01); *A45D 44/08* (2013.01); *A47K 10/02* (2013.01)

(58) Field of Classification Search

CPC ..... A42B 1/04; A42B 1/041
USPC ..... 2/174
See application file for complete search history.

(56) References Cited

U.S. PATENT DOCUMENTS

| | | | | |
|---|---|---|---|---|
| 2,420,916 | A * | 5/1947 | Sorge | A45D 44/08 2/174 |
| 2005/0095393 | A1* | 5/2005 | Tabor-Cooper | A45D 44/08 428/99 |
| 2009/0300815 | A1* | 12/2009 | Nunez | A41D 13/04 2/50 |
| 2012/0284893 | A1* | 11/2012 | Sohn | A41D 1/205 2/46 |
| 2014/0352167 | A1* | 12/2014 | Peters | A47K 10/02 34/353 |
| 2015/0366329 | A1* | 12/2015 | Manning | A45D 44/08 2/50 |

* cited by examiner

*Primary Examiner* — Katherine Moran
(74) *Attorney, Agent, or Firm* — Erickson Law Group, PC

(57) ABSTRACT

A hair towel cape is provided having a body having a neck opening, a first layer, and a second layer. The first layer is joined to the second layer. The first layer is located on a first side of the body. The first layer has a water absorbent material. The second layer is located on a second side of the body. The second layer has a waterproof or water repellent material. The second side is opposite of the first side.

20 Claims, 8 Drawing Sheets

TOWEL CAPE AND METHOD

This application claims the benefit of U.S. Provisional Patent Application No. 61/990,470, filed on May 8, 2014, which is incorporated by reference.

FIELD OF THE INVENTION

The invention relates to a device for use in grooming, hair care, and hair styling.

BACKGROUND OF THE INVENTION

Towels and specialty hair drying towels are known for removing moisture from hair to at least partially dry the hair. Capes, wraps and smocks are known for protecting the wearer's body and clothes in the area covered by the cape, wrap, or and smock during the process of caring/styling of hair. Many hair care and hair styling techniques and processes require the use of a towel and a separate protective cape. Therefore multiple items are required to the hair care/styling process.

The inventor recognized the need for a device that provides absorbency features as well as protective features. The inventor recognized the need for a device that reduces the number of items needed during certain hair care or hair styling activities. The present inventor recognized the need for a device that aids in hair care, including but not limited to drying, cutting, coloring, or treating and/or styling.

SUMMARY OF THE INVENTION

A hair towel cape is disclosed. In one embodiment, the hair towel cape comprises a flexible body. The body comprises a first layer joined to a second layer. The first layer is located on a first side of the body. The first layer comprising a water absorbent material. The second layer is located on a second side of the body. The second layer comprising a waterproof material. The second side is opposite of and joined to the first side.

The body comprises a first portion, a first wing, a second wing, and a curved neck perimeter. The curved neck perimeter at least partially defines an inner boundary of the first wing and an inner boundary of the second wing. The curved neck perimeter forms a neck opening. The curved neck perimeter comprises a first perimeter end and a second perimeter end. An access gap is provided between the first and second perimeter ends.

The first wing comprises a first fastener element. The second wing comprises a second fastener element. The first and second fastener elements are configured to releasably join together to connect the first and second wings and to releasably close the access gap so that the neck opening is completely surrounded by the body.

The first portion comprises a bottom edge and an elongated strap. The bottom edge is opposite the neck opening. The elongated strap is located on the second side between the neck opening and the bottom edge. The elongated strap comprises a first strap end, a second strap end, and a detached portion. The detached portion is located between the first strap end and the second strap end. The first and second strap ends are each attached to the second side. The detached portion is detached from the second side. At least the first strap end or the second strap end is releasably attached to the second side. The first portion is opposite of the first wing and the second wing.

A method of using a hair towel cape is disclosed. In one embodiment, a first edge of a towel cape is placed across a user's forehead at or below a hair line of the user. The towel cape comprises a first side and an opposite second side. The first side comprising a water absorbent material. The second side comprising a water proof material. The first side faces the user's forehead.

Opposite first and second end are drawn around to a nape of a neck of the user, collecting any hair between the first and second ends at the nape. The first and seconds ends are at oppose ends of the first edge. The first and second ends are twisted together with the user's hair between the first and second ends to create a twisted portion of the towel cap. The twisted portion is moved towards a crown or a top of the user's head.

A first strap end of an elongated strap is released from an attached condition at an attachment location on the second side of towel cape. The twisted portion is placed between a second strap end of the elongated strap and the attachment location. The second strap end of the elongated strap is connected to the second side and is spaced apart from the attachment location.

The strap is placed over the twisted portion and the first strap end of the elongated strap is connected to the attachment location to hold the twisted portion to or adjacent the top or the crown the user's head. The hair is at least partially allowed to dry by contact with the first side.

The first strap end of an elongated strap is released from the attachment location. The first and second ends of the first edge are untwisted. A first wing and a second wing of the towel cape are moved in front of a shoulders of the user so that a curved neck edge of the towel cape surrounds at least a portion of the user's neck. A first portion of the towel cape is placed on or adjacent a back of the user.

The first wing or the second wing is connected with the other of the first wing or the second wing to close an access opening to a neck opening of the towel cape so that the towel cape surrounds the user's neck.

Numerous other advantages and features of the present invention will become readily apparent from the following detailed description of the invention and the embodiments thereof, from the claims and from the accompanying drawings.

DETAILED DESCRIPTION

Figure 1:
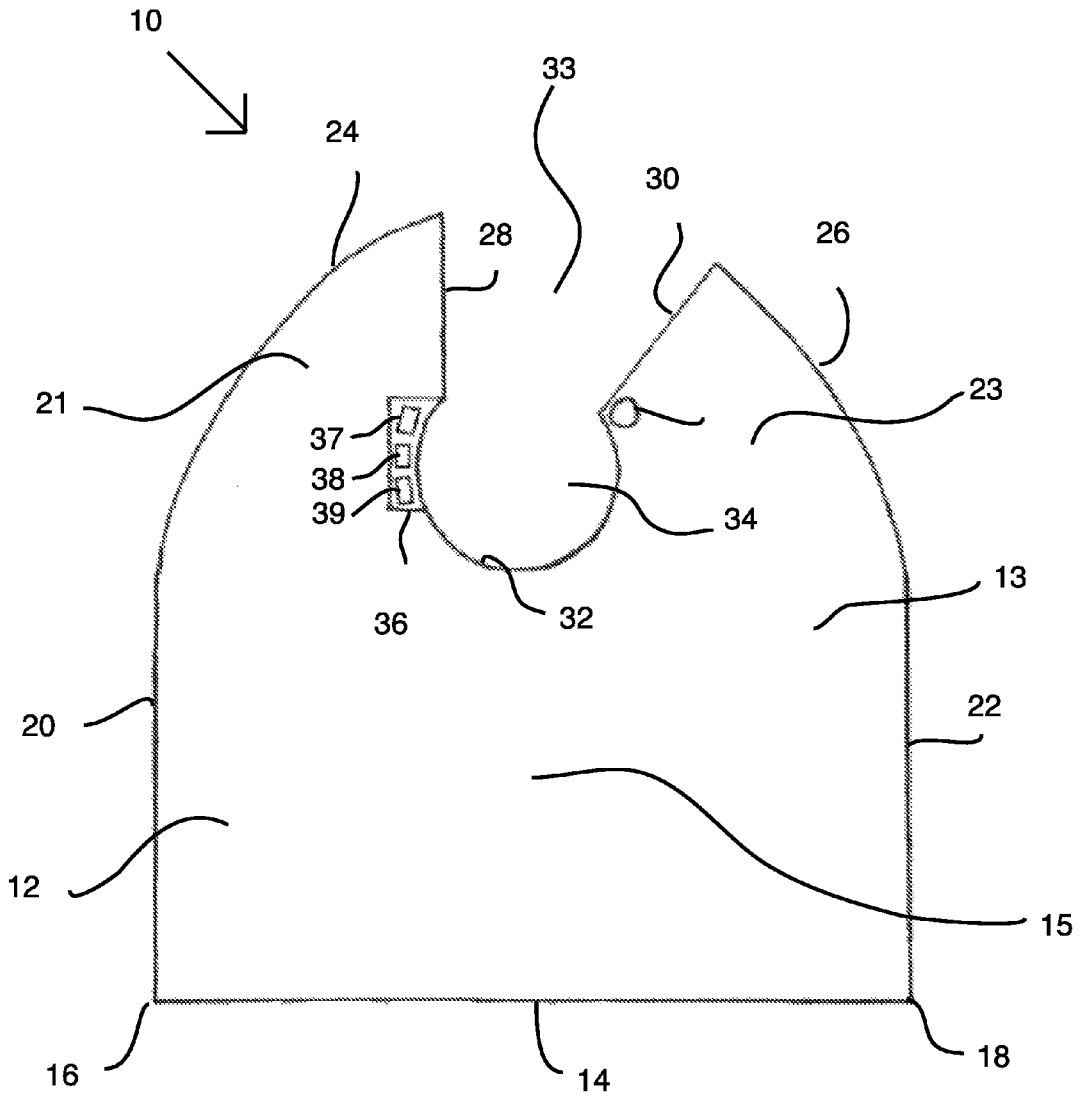
FIG. 1 shows a front view of a towel cape of the invention laid flat.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 shows a first side 12 of a hair towel cape 10. The towel cape 10 comprises a body, 13, a bottom edge 14, a first side edge 20, a second side edge 22, a first curved edge 24, a second curved edge 26, a neck edge 32, a first access edge 28, and a second access edge 30. A first corner 16 joins the bottom edge 14 with the first side edge 20. A second corner 18 joins the bottom edge 14 with the second side edge 22. In some embodiments, the bottom edge 14 is perpendicular to each of the first and second side edges 20, 22. The body comprises a first portion 15, a first wing 21, and a second wing 23. The first portion extends between the bottom 64 of the neck edge and the bottom edge 14. The first wing 21 and the second wing 23 each extend from the bottom 64 and opposite and away from the bottom edge 14.

The first curved edge 24 joins with the first side edge 20. The second curbed edge 26 joins with the second side edge 22. The first and second curved edge 24, 26 form a boundary of the towel cape 10 opposite the bottom edge 14, except in an access gap 33 between the first access edge 28 and the second access edge 30.

The access gap 33 is formed by the gap between the first access edge 28 and the second access edge 30. The access gap 33 provides access to the neck opening 34. The neck opening 34 is partially bounded by the neck edge 32, which is curved. In some embodiments, the neck edge is partially circular, between the first access edge 28 and the second access edge 30. In some embodiments, the neck edge 32 extends 180 to 230 degrees, or any increment there between, between the first access edge 28 and the second access edge 30.

In some embodiments, the first access edge is parallel to the first side edge 20 and is perpendicular to the bottom edge 14. In some embodiments, as shown in FIG. 1, the second access edge is not parallel to the first access edge, but is at an acute angle to the first access edge. In some embodiments, the second access edge is parallel and may be spaced apart from the first access edge.

Beginning adjacent the intersection of the neck edge with the first access edge is a first joining area 36, which extends adjacent and about the neck edge. The first joining area 36 comprises one or more first fastener elements, such as a first, second, and third loop patches 37, 38, 39 of loops of hook and loop type fasteners. Other releasable fasteners known in the art, such as snap buttons, a slot and button arrangement, magnets, or the like can be used. While the first joining area 36 is delineated by a line, such area may or may not have a visible boundary.

Figure 2:
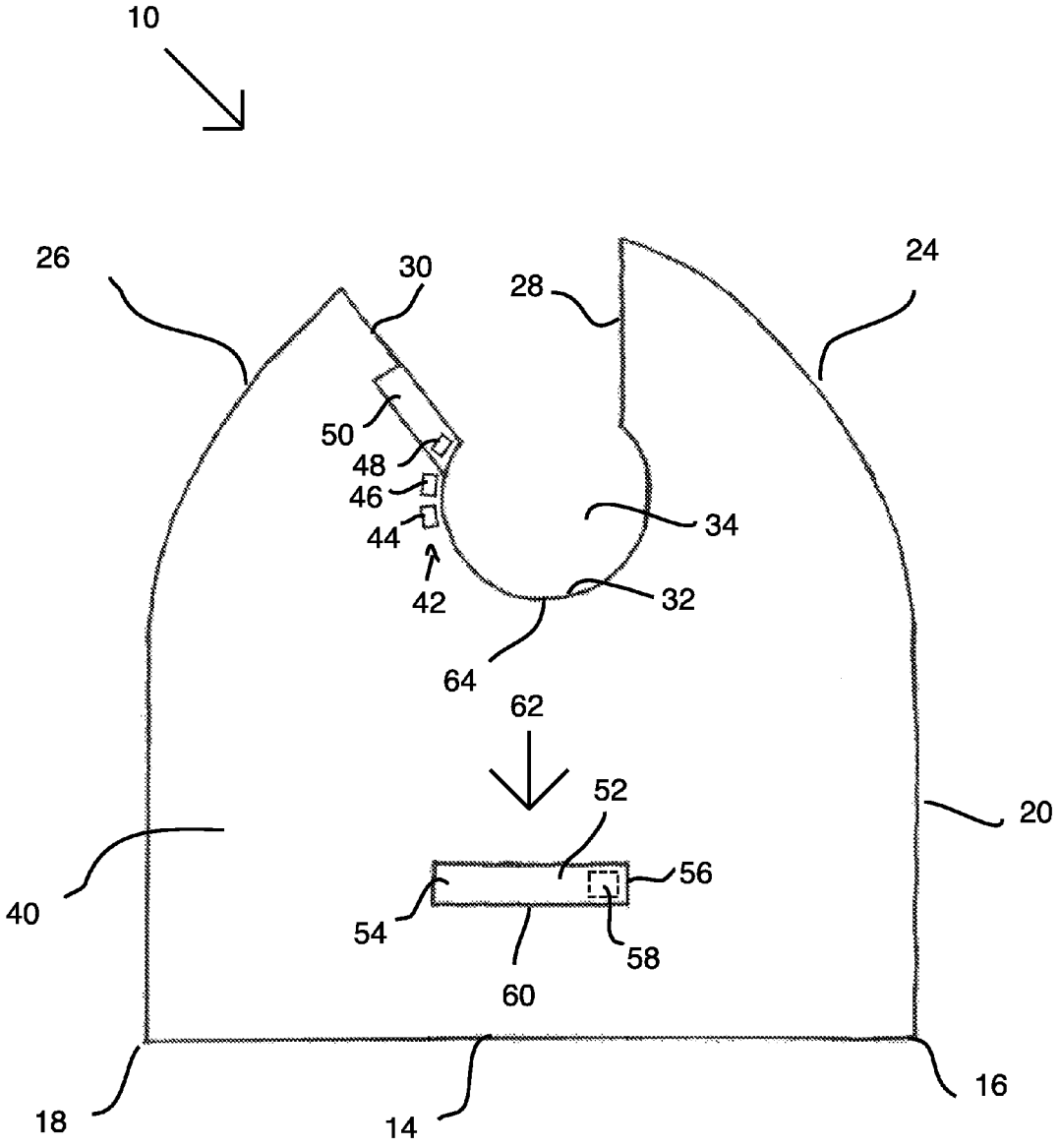
FIG. 2 shows a back view of the towel cape of FIG. 1 laid flat.

FIG. 2 shows a second side 40 of the towel cape 10, opposite the first side 12. The second side has a second joining area 42. The second joining area comprises one or more second fastener elements, such as first, second, and third hook patches 44, 46, 48 of hooks of the hook and loop type fasteners. Other releasable fasteners known in the art, such as snap buttons, a slot and button arrangement, magnets, or the like can be used. The hook patches 44, 46, 48 are configured to join and releasably connect to the loop patches 37, 38, 39, and vise-versa. The hook patches join with the loop patches to close the access gap 33 and the neck opening 34 will be fully closed by the neck edge. The size of the neck opening can be varied depending on which are of the hook patch(es) are connected with which of the loop patch(es). The loop patches and the hook patches can be swapped so that the patches 44, 46, 48 comprises loops and patches 37, 38, 39 comprises hooks.

The second side 40 of the body comprises a strap 52. The strap is elongated. In some embodiments, the strap is permanent secured at a first strap end 54 to the second side 40. The strap is releasably secured to the second side 40 at a second strap end 56. A fastener 58 such as a hook and loop fastener, with on fastener component connected to the second side and a corresponding fastener component connected to the second strap end 56, can be used to releasably secure to the second side 40 at a second strap end 56. The bottom of the strap can carry a group of hook elements or loop elements, and the area opposite the strap at the fastener 58 on the second side can carry the other of hook elements or loop elements. At least a middle area 60 between the first strap end 54 and the fastener 58 is not joined to the second side 40. Therefore an opening can be formed in the middle area 60 between the strap and the second side 40 opposite the strap so that the user's hair and/or a portion of the towel cape can be provided in a direction 62 through the gap and secured down with the strap.

The strap is located in a section of the second side that is between the bottom edge 14 and one third of the distance to the bottom 64 of the neck edge 32. In some embodiments, the strap is located in a section that is between one third and two thirds of the distance between the bottom edge 14 and the bottom 64. In some embodiments, the strap is located in the middle between the bottom edge 14 and the bottom 64. In some embodiments, the middle 60 of the strap is horizontally, as oriented in the manner of FIG. 2, aligned with the bottom 64 and the center (not labeled) of the neck edge, if the neck edge is circular. In some embodiments, the middle 60 of the strap is horizontally aligned with a middle (not labeled) of the bottom edge 14.

In some embodiments, the second side 40 has a third fastener area 50 that can comprise one or more fasteners, such as hook and loop fasteners to join with corresponding fasteners on the first side 12. The boundary of the third fastener area 50 may or may not be visible.

The first side 12 comprises a water absorbent material. In some embodiments, the water absorbent material comprises one or more of: textile, fabric, cloth, cotton, terry cloth, French terry cloth, rayon, bamboo, viscose, polyvinyl alcohol (PVA), and microfiber. The microfiber can comprise one or more of polyesters, polyamides, or a conjugation of polyester, polyamide, and polypropylene. The water absorbent material may also comprise elastane to provide an elastic characteristic. The water absorbent material may be the outermost layer or if not, then the outermost layer(s) is water permeable to allow water to pass to the water absorbent layer. The water absorbent material is capable of absorbing liquids other than water as well.

The second side 40 comprises at least one of a waterproof or water repellent material. In some embodiment, the waterproof material comprises one or more of: rubber, silicone elastomer, fluoropolymers, wax, or plastic, such as polyvinyl chloride (PVC), polyurethane (PU). The waterproof material may comprise natural or synthetic fabrics coated or laminated with one or more of the materials listed in the prior sentence. In some embodiments, the water repellent material comprises a fabric coated with a durable water repellent coating. The coating may comprise fluoropolymer. In some embodiments, the water repellent/resistant material comprises a polyester microsuede having a water repellent finish.

In some embodiments, the second side comprises a heat resistant material. In some embodiments, the heat resistant material comprises a polyester fabric, such as a polyester microsuede, that will soften with exposure to temperatures of 238 to 249 degrees Celsius and will begin to melt at the temperature of 250 degrees Celsius and above. The heat resistant feature protects the user from heat generated by hair styling devices, such as a hot hair curling iron. Occasionally, a user may accidentally touch or drop the hot hair curling iron against the user's skin when styling hair, which can cause burns. The heat resistant material can protect the user from such accidental contact with the user's skin. In some embodiments, the water repellent or waterproof material is also heat resistant material.

The towel cape 10 may be created by cutting the water absorbent material in the shape of the towel cape shown in FIG. 1. A water proof or water repellent material is cut in the shape of the towel cape of shown in FIG. 1. It will be recognized that shapes, other than the one shown in the figures, could be used, such as shapes common to traditional hair styling capes or specialty hair towels modified to have at least the neck opening. Then the water absorbent material and the water proof or water repellent material are joined together so that the water absorbent material comprises the first side 12 and the water proof or water repellent material comprises the second side 40. Therefore, the water absorbent material may be considered a first layer and the water proof or water repellent material may be considered a second layer. The first and second layers may be joined by providing an adhesive, such as glue, between the layers. The first and second layers may be joined by thread used to sew the layers together. The layers may be sewn about the entire, or portion(s), of the perimeter of the towel cape. The layers may also be sewn and/or adhered together throughout the body 13 of towel cape between the perimeter edges in a repeating pattern, an irregular pattern, or randomly. The first and second layers are flexible.

Figure 3:
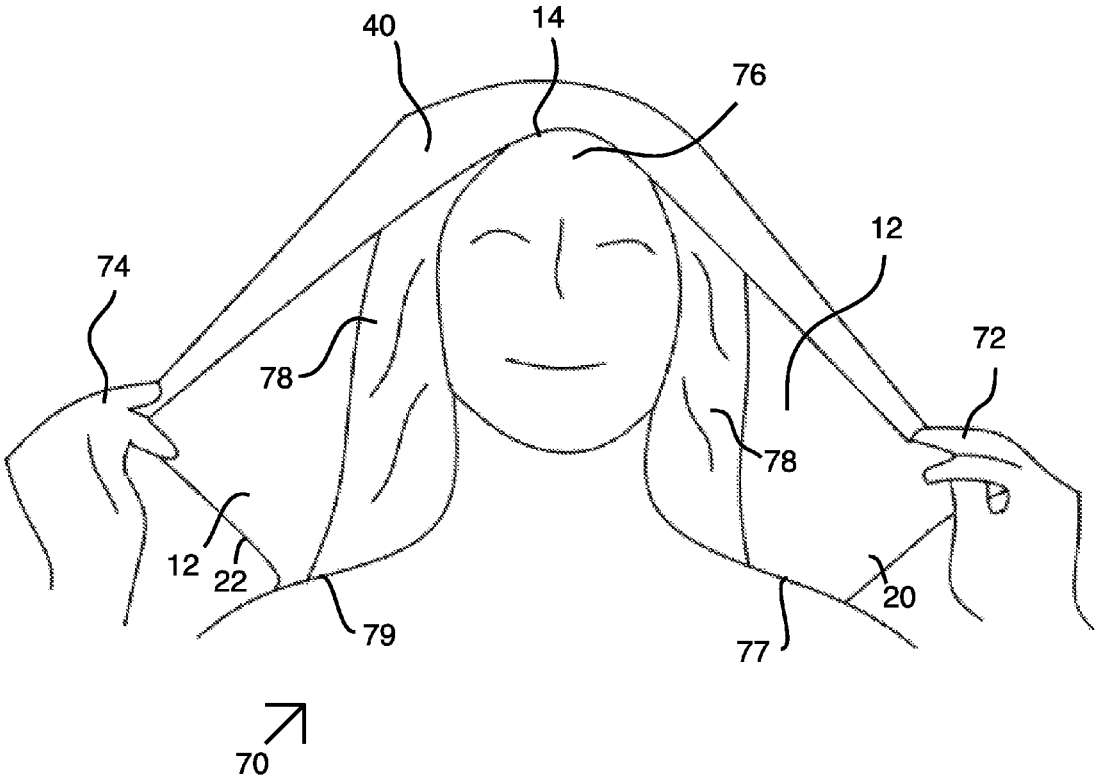
FIG. 3 shows the towel cape of FIG. 1 in a first state of use.

FIGS. 3-8 show the towel cape in various stages of use. The towel cape 10 can be used to remove moisture to at least partially dry or completely dry wet hair. As shown in FIG. 3, the bottom edge 14 of the towel cape is placed along a forehead 76 of a user 70 at or below the user's hairline. The first side 12, having a water absorbent material, is orientated downward so that it comes in contact with the user's hair 78. The second side, having the water proof/resistant material, is oriented upward. The user 70 uses his/her hands 72, 74 to grab the first and second corners 16, 18, respectively. The user draws the first and second corners back towards the nape of the neck, on each side respectively, making sure the hair 78 is trapped behind towel, particularly the bottom edge 14, and in contact with the first side 12.

Figure 4:
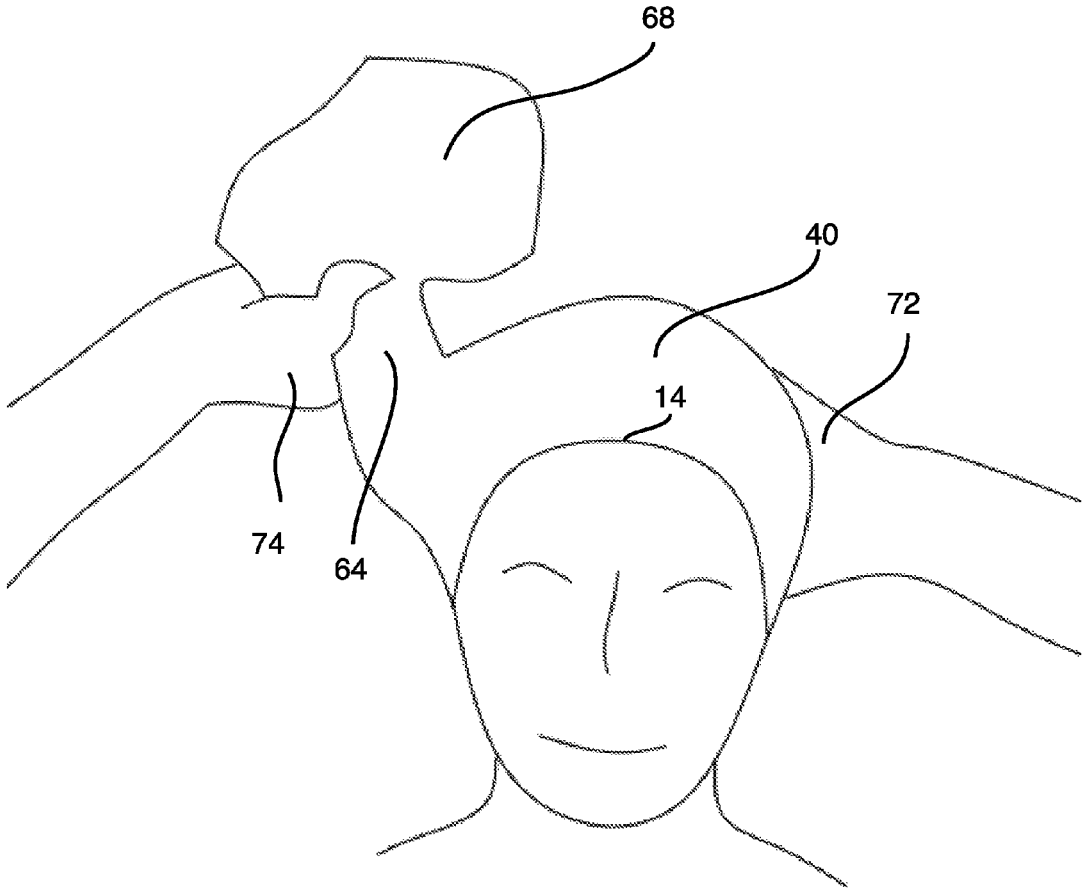
FIG. 4 shows the towel cape of FIG. 1 in a second state of use.

Then as shown in FIG. 4, the first and second corners 16, 18 together with the hair are twisted at or adjacent the back of head/neck to form a twisted tail 64. In some processes, the first side 12 of the towel cape can be moved back and forth, or in other paths relative to the hair to increase the absorption of the liquid from the hair, as can be done with a traditional towel, before the towel cape is drawn back and wrapped at the back of the neck.

Figure 5:
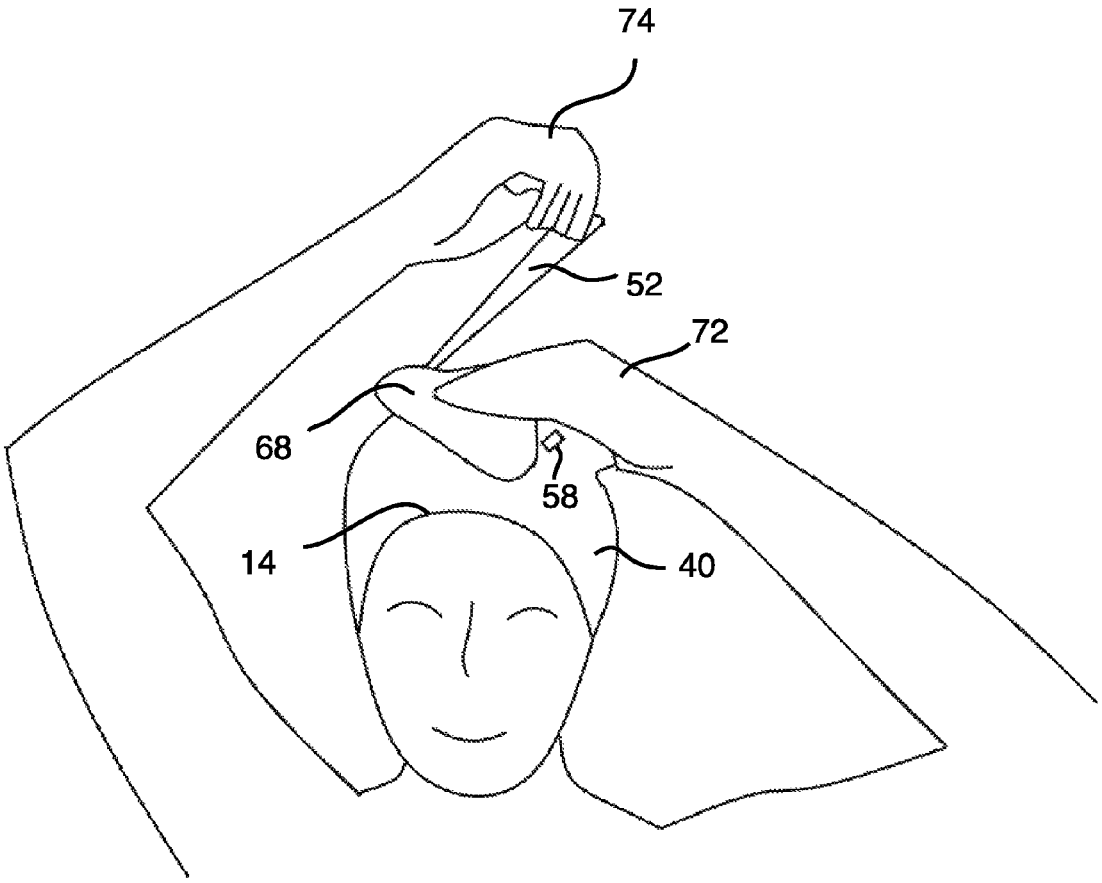
FIG. 5 shows the towel cape of FIG. 1 in a third state of use.

As shown in FIG. 5, the fastener 58 disconnected to disconnect the second strap end 56 from the second side 40. The tail 64 is placed on the crown or the top of the head between the first strap end 54 and the fastener 58. The strap is drawn over the tail 64 and releasably secured to the second side 40 at the fastener 58 by the fastener 58 to hold the tail above or to the crown or top of the head. The end 68 of the tail may extend forward as shown in FIG. 5. The user's left hand 72 will hold the tail 64 and/or end 68 to the head and the right hand 74 will attach the strap to the fastener 58. However, the procedure can be complete by using opposite hands. Therefore the towel cape will keep the hair wrapped against/adjacent the head and towel cape 10. The first side 12 having the water absorbent material will absorb the moisture from the hair while in contact with the hair.

To remove the towel cape 10 from the hair when in a twisted overhead configuration of FIG. 5, release the strap 52 from the second side 40 with the fastener 58. Move the twisted tail to the back of the head or neck and untwist. Alternatively allow the tail to fall backwards and untwist under the force of gravity and reverse rotation potential, which was created by twisting the hair/towel cape in the first place. Untwist any further amount as necessary. Separate the first corner 16 from the second corner 18.

Figure 6:
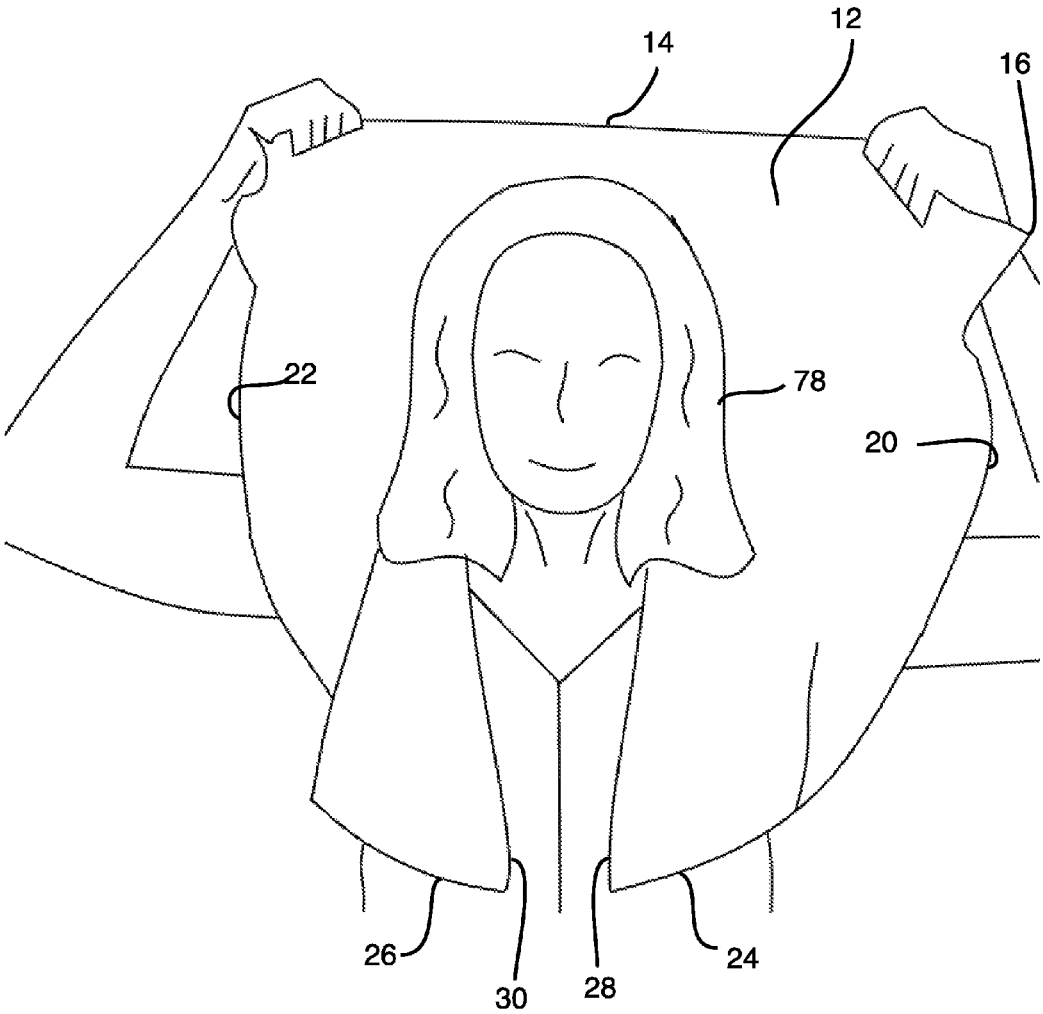
FIG. 6 shows the towel cape of FIG. 1 in a fourth state of use.

Bring the first wing 21 and first curved edge 24 and the second wing 23 and the second curved edge 26 over and in front of the users shoulders 77, 79, bring with it the hair so that hair that would otherwise fall behind the shoulder extends in front of the shoulder as is shown in FIG. 6. The back and sides of user's neck will be surrounded or adjacent to the neck edge 32. The first curved edge 24 and the second curved edge 26 will lay over the user's chest. A portion of the first wing and the second wing will also will lay over the user's chest and shoulders. The first portion and the bottom edge 14 are allowed to fall back and rest on or adjacent to the user's back.

Figure 7:
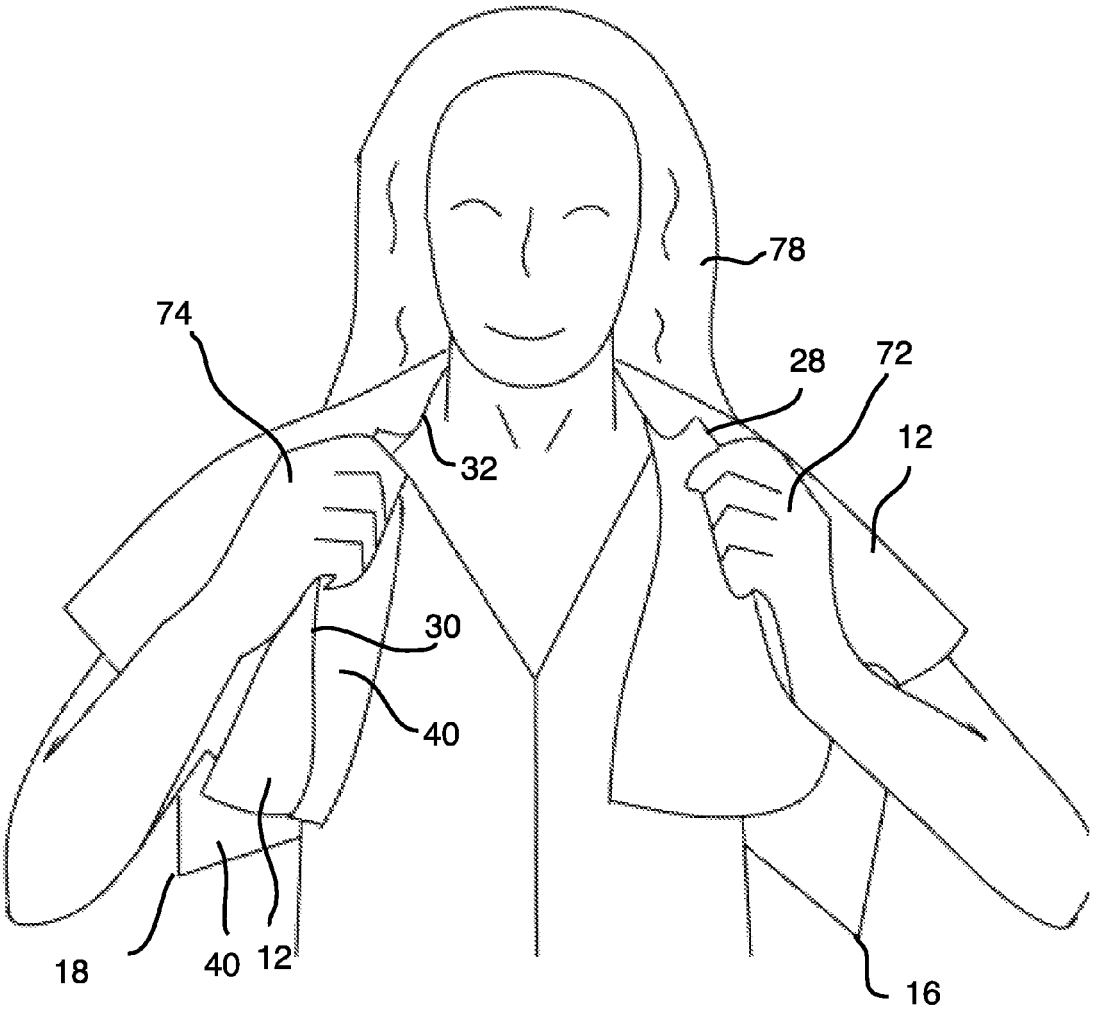
FIG. 7 shows the towel cape of FIG. 1 in a fifth state of use.
Figure 8:
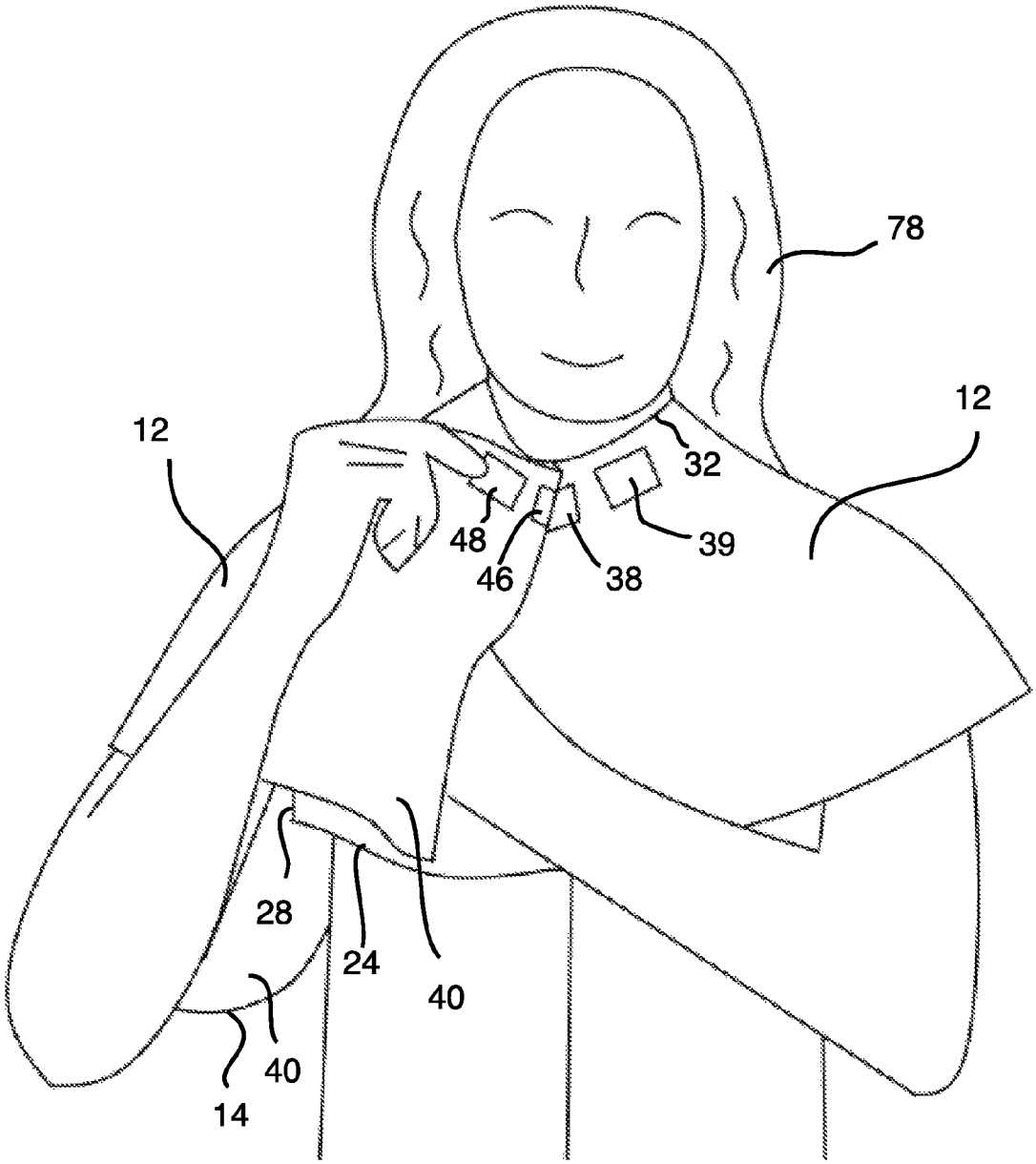
FIG. 8 shows the towel cape of FIG. 1 in a sixth state of use

The user grabs the first access edge 28 with the left hand 72 and the second access edge 30 with the right hand 74 as shown in FIG. 7. Hair may optionally be moved back behind the shoulders to rest on a portion of the first portion 15 of the first side 12 that extends down the user's back. As shown in FIG. 8, the user draws the first access edge 28 under and overlaps the portion of the towel cape extending from the second access edge 30. The fasteners of patches 37, 38, 39 are aligned with patches 44, 46, 48, respectively, to secure the towel cape about the user's neck. The towel cape will cover the user's chest, shoulders, and the user's back so that cut hair or styling products applied to the hair will not get on the user in the area's covered by the towel cape.

The water proof/resistant nature of the second side 40 will prevent the water or other liquids, if any absorbed, on the first side 12 from bleeding through and getting on to the user. Also water or liquid product on the hair will not penetrate through the second side 40 to get on the user's clothes or skin. It is not required that all of patches 37, 38, 39 align with corresponding patches 44, 46, 48, depending on the size of the user's neck, 3, 2, 1, or a portion of one patch on the first side can align with 3, 2, 1, or a portion of one patch on the second side. Therefore the size of the neck opening 32 will can vary depending on the degree of overlap between the wings and the selected fasteners portions for connecting. The towel cape can be rotated to the left or right about the user's neck to align the towel cape in the desire orientation or to achieve coverage in the desired areas. In one process, the corners 16, 18 can be leveled at the same vertical location at the user's back.

While the towel cape is capable of first being used as a hair towel and then being used as a cape or vice versa, the towel cape can also be used as a hair towel only or as a cape only in a given application. It is not necessary that the towel cape be used as a hair towel and a cape in each application, it is sufficient that it is capable of such use, even if it is not actually used for both activities in every application.

The towel cape can be hung dry by hanging over or attaching the bottom edge 14 to a towel bar/rack. The towel cape can be used in salons, at home, or in other locations. The towel cape can be used in non-hair styling situations, such as where the user desires to protect the neck, shoulders, chest, and/or back from liquid or debris. Such applications can include makeup applications and facial hair shaving, cutting, or trimming situations. The towel cape can be used in any application where a towel could be used, such as to dry hair or to scrunch hair or to remove excess hair product from hair. The towel cape can be used in situations where the user needs both absorbency and waterproof/water repellent protection. In some applications, the waterproof side can be position upward, and the water absorbent side can be positioned down toward the user's shoulders, in cases where water absorbency is not needed for the hair.

The towel cape can comprise materials of different colors, or the materials provided may comprise multiple colors or patterns. In some embodiments, the first side 12 comprises a different color or pattern from the second side 40.

In some embodiments when the towel cape is laid flat as shown in FIG. 1, the distance between the first side edge 20 and the second side edge 22 is 27 inches, the distance between the bottom 64 of the neck edge 32 and the bottom edge 14 is 15.5 inches, the distance between the bottom edge 14 and the intersection of the second curved edge 26 and the second access edge 30 is 28.5 inches, and the distance between the bottom edge 14 and the intersection of the first curved edge 24 and the first access edge 28 is 29.5 inches.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A hair towel cape, comprising:

a body that is flexible;

the body comprises a first layer joined to a second layer;

the first layer located on a first side of the body, the first layer comprising a water absorbent material;

the second layer located on a second side of the body, the second layer comprising a waterproof or water repellent material, the second side is opposite of and joined to the first side;

the body comprises a first portion, a first wing, a second wing, and a curved neck perimeter, the curved neck perimeter at least partially defining an inner boundary of the first wing and an inner boundary of the second wing, the curved neck perimeter forming a neck opening, the curved neck perimeter comprising a first perimeter end and a second perimeter end, an access gap is provided between the first and second perimeter ends, the first portion opposite the first wing and the second wing;

the first wing comprising a first fastener element, the second wing comprising a second fastener element, the first and second fastener elements are configured to releasably join together to connect the first and second wings and to releasably close the access gap so that the neck opening is completely surrounded by the body;

the first portion comprises a bottom edge and an elongated strap, the bottom edge is opposite the neck opening, the elongated strap is located on the second side between the neck opening and the bottom edge, the elongated strap comprises a first strap end, a second strap end, and a detached portion, the detached portion located between the first strap end and the second strap end, the first and second strap ends are each attached to the second side, detached portion is detached from the second side, at least the first strap end or the second strap end is releasably attached to the second side.

2. The hair towel cape of claim 1, wherein the first fastener element is located on the first or second side and the second fastener element is located on the other of the first or second side.

3. The hair towel cape of claim 1, wherein the first and second fastener elements comprise hook and loop fasteners.

4. The hair towel cape of claim 1, wherein the first and second fastener elements are located adjacent the curved neck perimeter.

5. The hair towel cape of claim 1, wherein the water absorbent material is selected from a group consisting of: French terry cloth and terry cloth.

6. The hair towel cape of claim 1, wherein the water absorbent material is selected from a group consisting of: textile, fabric, cloth, cotton, rayon, bamboo, viscose, polyvinyl alcohol, and microfiber.

7. The hair towel cape of claim 1, wherein the waterproof or water repellent material is selected from a group consisting of: rubber, silicone elastomer, fluoropolymers, wax, polyvinyl chloride, and polyurethane.

8. The hair towel cape of claim 1, wherein the first portion comprises a first side edge, a second side edge, the first side edge is opposite the second side edge, the bottom edge extends between the first and second side edges, the elongated strap is spaced inward from the neck opening, the first side edge, the second side edge, and the bottom edge.

9. The hair towel cape of claim 1, wherein the elongated strap is aligned horizontally with the neck opening.

10. The hair towel cape of claim 1, wherein the first wing and the second wing each comprise a curved perimeter edge.

11. The hair towel cape of claim 1, wherein the first wing comprises a first access edge joining with the first perimeter end, the second wing comprises a second access edge joining with the second perimeter end, the first access edge and the second access edge forming an access path, the access path joining with the access gap; the access path is at least partially closed when the first and second fastener elements are joined.

12. The hair towel cape of claim 11, wherein the second access edge is positioned at an acute angle to the first access edge at least when the first wing is disconnected from the second wing and the hair towel cape is laid on a flat surface.

13. A method of using a towel cape, comprising the steps of:

placing a first edge of the towel cape across a forehead of a user at or below a hairline of the user, the towel cape comprising a first side and an opposite second side, the first side comprising a water absorbent material, the second side comprising a waterproof or water repellent material, the first side facing the forehead;

drawing a first end of the first edge and a second end of the first edge around to a nape of a neck of the user, collecting any hair between the first and second ends at the nape;

twisting the first and second ends together with hair, of the user, between the first and second ends to create a twisted portion of the towel cape;

moving the twisted portion towards a top or a crown of the a head of the user;

placing a strap over the twisted portion and connecting a first strap end of the strap to an attachment location on the second side to hold the twisted portion to the head on the second side between the attachment location and a second strap end of the strap, the second strap end of the strap is connected to the second side and is spaced apart from the attachment location;

allowing the hair to at least partially dry;

releasing the first end of the strap from the attachment location;

moving a first wing of the towel cape and a second wing of the towel cape over the shoulders of the user so that at least a portion of the first wing and at least a portion of the second wing extend over a chest of the user and a curved neck edge of the towel cape surrounds at least a portion of the neck of the user and the second side faces down toward the a body of the user;

connecting the first wing or the second wing with the other of the first wing or the second wing to close an access opening to a neck opening of the towel cape so that the towel cape surrounds the neck of the user.

14. The method of claim 13, comprising the step of, before the step of placing the strap over, releasing the first strap end of the strap from the attachment location, and placing the twisted portion between the second strap end of the strap and the attachment location.

15. The method of claim 13, comprising the step of before moving the first wing and the second wing, untwisting the first and second ends of the first edge.

16. The method of claim 13, comprising the step of before connecting the first wing or the second wing, positioning a first portion of the towel cape on or adjacent a back of the user.

17. The method of claim 13, wherein the step of connecting the first wing or the second wing with the other of the first wing or the second wing, comprises the step of overlapping the connecting the first wing or the second wing with the other of the first wing or the second wing.

18. The method of claim 13, wherein the step of connecting the first wing or the second wing with the other of the first wing or the second wing, comprises the step of connecting the first wing or the second wing with the other of the first wing or the second wing with a hook and loop fastener.

19. The method of claim 13, wherein the step of connecting the first wing or the second wing with the other of the first wing or the second wing, comprises the step of connecting the first wing or the second wing with the other of the first wing or the second wing by connecting a fastener or a fastener receiver located on the first side with the other of the fastener or the fastener receiver located on the second side.

20. A hair towel cape, comprising:

a body that is flexible;

the body comprises a first layer joined to a second layer;

the first layer located on a first side of the body, the first layer comprising a water absorbent material;

the second layer located on a second side of the body, the second layer comprising a water resistant material, the second side is opposite of and joined to the first side;

the body comprises a first portion, a first wing, a second wing, and a curved neck perimeter, the curved neck perimeter at least partially defining an inner boundary of the first wing and an inner boundary of the second wing, the curved neck perimeter forming a neck opening, the curved neck perimeter comprising a first perimeter end and a second perimeter end, an access gap is provided between the first and second perimeter ends, the first portion opposite the first wing and the second wing;

the first wing comprising a first fastener element, the second wing comprising a second fastener element, the first and second fastener elements are configured to releasably join together to connect the first and second wings and to releasably close the access gap so that the neck opening is completely surrounded by the body;

the first portion comprises a bottom edge and an elongated strap, the bottom edge is opposite the neck opening, the elongated strap is located on the second side between the neck opening and the bottom edge, the elongated strap comprises a first strap end, a second strap end, and a detached portion, the detached portion located between the first strap end and the second strap end, the first and second strap ends are each attached to the second side, detached portion is detached from the second side, at least the first strap end or the second strap end is releasably attached to the second side.

* * * * *